US011661702B2

(12) United States Patent
Motohashi et al.

(10) Patent No.: US 11,661,702 B2
(45) Date of Patent: May 30, 2023

(54) FIBER TRANSPORT APPARATUS AND FIBER TRANSPORT METHOD

(71) Applicant: SEIKO EPSON CORPORATION, Tokyo (JP)

(72) Inventors: Koji Motohashi, Nagano (JP); Makoto Sato, Nagano (JP); Takashi Abe, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 436 days.

(21) Appl. No.: 16/902,324

(22) Filed: Jun. 16, 2020

(65) Prior Publication Data

US 2020/0399830 A1 Dec. 24, 2020

(30) Foreign Application Priority Data

Jun. 18, 2019 (JP) ..... JP2019-112947

(51) Int. Cl.
*D21F 1/06* (2006.01)
*D21F 1/02* (2006.01)

(52) U.S. Cl.
CPC ..... *D21F 1/026* (2013.01)

(58) Field of Classification Search
USPC ..... 162/216
See application file for complete search history.

(56) References Cited

U.S. PATENT DOCUMENTS 5,722,529 A 3/1998 Manjunath et al.

FOREIGN PATENT DOCUMENTS

CN 108609404 A 10/2018
JP 2011-241497 A 12/2011

*Primary Examiner* — Jacob T Minskey
(74) *Attorney, Agent, or Firm* — Global IP Counselors, LLP

(57) ABSTRACT

A sheet manufacturing apparatus includes a case that accommodates raw material pieces including fibers, a rotator that rotates inside the case to stir the raw material pieces, a stirring motor that rotates the rotator, a transport apparatus that transports the raw material pieces through a transport path coupled to a side wall of the case, and a control apparatus that controls rotation states of the rotator and the transport apparatus, in which the transport apparatus includes a discharge pipe that rotates on a central axis along the transport path, and a transport motor that rotates the discharge pipe.

8 Claims, 11 Drawing Sheets

FIBER TRANSPORT APPARATUS AND FIBER TRANSPORT METHOD

The present application is based on, and claims priority from JP Application Serial Number 2019-112947, filed Jun. 18, 2019, the disclosure of which is hereby incorporated by reference herein in its entirety.

BACKGROUND

1. Technical Field

The present disclosure relates to a fiber transport apparatus and a fiber transport method.

2. Related Art

In the related art, a transport apparatus which transports fiber pieces stirred inside a container from the container is known. For example, JP-A-2011-241497 discloses a configuration in which an outlet is provided on a bottom surface of a storage container in which a paper material is stirred, and a rectangular frame-shaped casing extending downwardly communicates with the outlet. In JP-A-2011-241497, the paper material is scraped into the casing from the outlet by a rotating shaft-shaped scraping rod disposed inside the casing. Further, in JP-A-2011-241497, the paper material dropped into the casing is discharged from the casing by a pair of rotatable delivery rollers arranged to face each other inside the casing.

In the configuration described in JP-A-2011-241497, the outlet is provided on the bottom surface of the container, and the fiber piece can be dropped from the outlet regardless of an operation state of the scraping rod, and when a state of the paper piece held between the delivery rollers varies, it is difficult to adjust the transport amount of fiber pieces.

SUMMARY

According to an aspect of the present disclosure, there is provided a fiber transport apparatus including: a case that accommodates fiber pieces containing fibers; a stirring portion that rotates inside the case to stir the fiber pieces; a first driving portion that rotates the stirring portion; a transport apparatus that transports the fiber pieces through a transport path coupled to a side surface of the case; and a control portion that controls rotation states of the stirring portion and the transport apparatus, in which the transport apparatus includes a rotator that rotates on an axis along the transport path, and a second driving portion that rotates the rotator.

In the fiber transport apparatus, the rotation states of the stirring portion and the rotator may be at least one of a rotation speed and a rotation direction of the stirring portion, and at least one of a rotation speed and a rotation direction of the rotator.

In the fiber transport apparatus, the rotator may be a tube that forms the transport path, and the second driving portion may rotate the tube.

In the fiber transport apparatus, one end of the tube in an axial direction may communicate with an internal space of the case, and the other end may have an outlet for discharging the fiber piece, and a protrusion may be disposed on an inner surface of the tube in a spiral shape on an axis of the tube.

In the fiber transport apparatus, the tube may be inclined so that the outlet is lower in a vertically downward direction than a coupling portion with the case.

In the fiber transport apparatus, the stirring portion may include a rotating portion that forms a part of a bottom surface of the case, and a blade erected on the rotating portion.

In the fiber transport apparatus, the transport path may be coupled to the case at an overlapping position with the blade in a height direction of the case.

In the fiber transport apparatus, a half-linear extension virtual line extending from the axis of the rotator to an outside of the transport path may be orthogonal to a virtual half-line extending from a rotation center of the stirring portion in a radial direction and defining a passing position of the stirring portion in a circumferential direction, at a position shifted from the rotation center of the stirring portion, and the control portion may rotate the stirring portion such that a portion of the stirring portion passing through the virtual half-line moves in a direction approaching the transport path.

In the fiber transport apparatus, a half-linear extension virtual line extending from the axis of the rotator to an outside of the transport path may be orthogonal to a virtual half-line extending from a rotation center of the stirring portion in a radial direction and defining a passing position of the stirring portion in a circumferential direction, at a position shifted from the rotation center of the stirring portion, and the control portion may rotate the stirring portion such that a portion of the stirring portion passing through the virtual half-line moves in a direction away from the transport path.

According to another aspect of the present disclosure, there is provided a fiber transport method of controlling a fiber transport apparatus including a case that accommodates fiber pieces containing fibers, a stirring portion that rotates inside the case to stir the fiber pieces, a first driving portion that rotates the stirring portion, a transport apparatus that transports the fiber pieces through a transport path coupled to a side surface of the case, and a control portion that controls the stirring portion and the transport apparatus, the transport apparatus including a rotator that rotates on an axis along the transport path and a second driving portion that rotates the rotator, the method including: causing the control portion to control the first driving portion and the second driving portion, adjusting a rotation state of each of the stirring portion and the rotator, and controlling a transport amount of the fiber pieces.

DESCRIPTION OF EXEMPLARY EMBODIMENTS

Hereinafter, appropriate embodiments of the present disclosure will be described in detail with reference to the accompanying drawings. The embodiments to be described below do not limit contents of the disclosure described in the claims. In addition, all of configurations to be described below are not essential components of the disclosure.

1. First Embodiment

1-1. Overall Configuration of Sheet Manufacturing Apparatus

Figure 1:
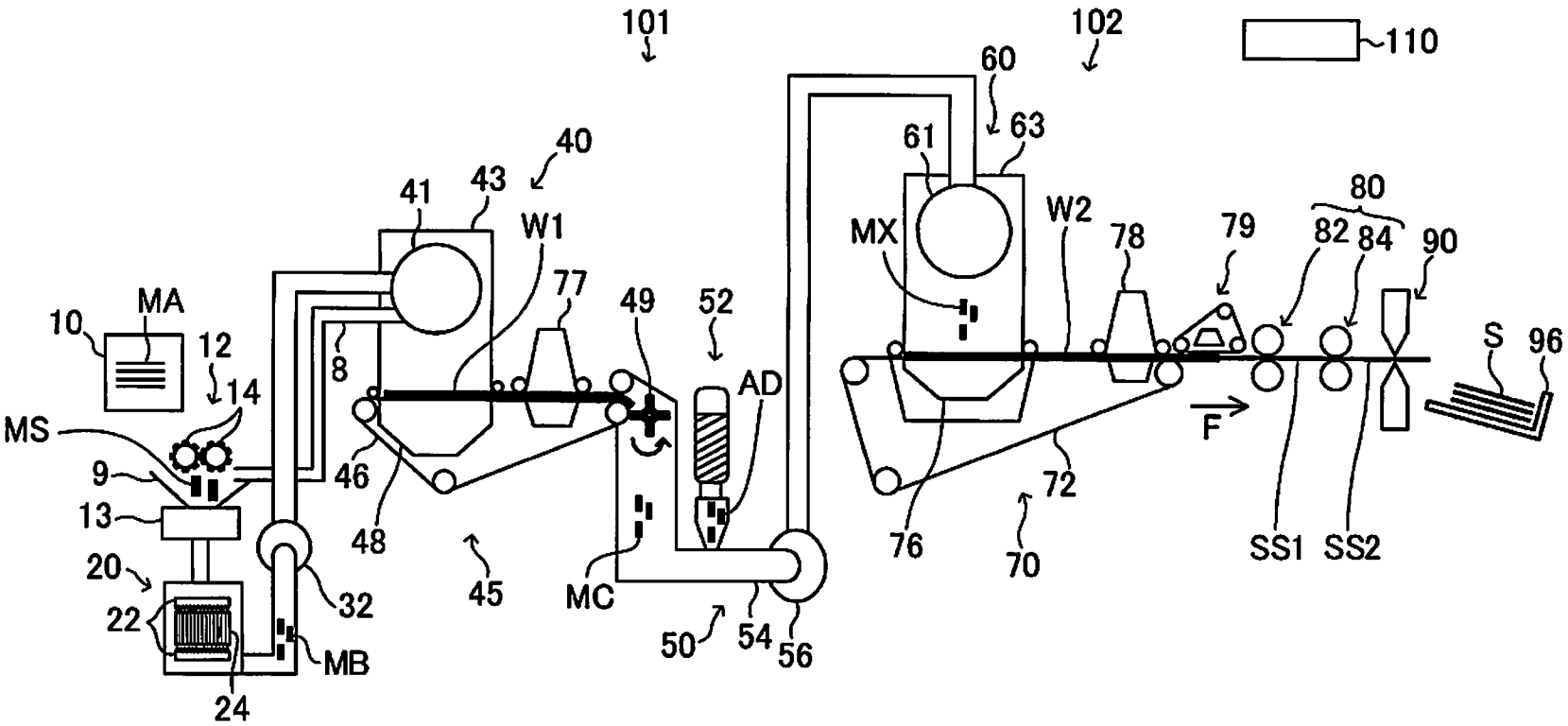
FIG. 1 is a diagram illustrating a configuration of a sheet manufacturing apparatus.

FIG. 1 is a diagram illustrating a configuration of a sheet manufacturing apparatus 100.

The sheet manufacturing apparatus 100 manufactures a sheet S by fiberizing a raw material MA containing fibers such as a wood-based pulp material or kraft pulp, waste paper, and synthetic pulp.

The sheet manufacturing apparatus 100 includes a supply portion 10, a crushing portion 12, a storage portion 13, a defibration portion 20, a sorting portion 40, a first web forming portion 45, a rotator 49, a mixing portion 50, a dispersion portion 60, a second web forming portion 70, a web transport portion 79, a processing portion 80, and a cutting portion 90.

The supply portion 10 supplies the raw material MA to the crushing portion 12. The crushing portion 12 is a shredder which cuts the raw material MA by a crushing blade 14. The raw material MA is cut into paper pieces by the crushing portion 12 to become raw material pieces MS, and the raw material pieces MS are collected by a hopper 9 and transported into the storage portion 13. The raw material piece MS can be referred to as a crushed piece or a cut piece, and corresponds to an example of a fiber piece containing fibers. The raw material piece MS has, for example, a rectangular shape with a length of approximately 20 mm and a width of approximately 3 mm.

The storage portion 13 temporarily stores the raw material pieces MS supplied from the crushing portion 12 and supplies a predetermined amount of raw material pieces MS to the defibration portion 20. As a result, it possible to stabilize the supply amount of raw material pieces MS supplied for a manufacturing process of the sheet S.

The defibration portion 20 defibrates the fine piece cut by the crushing portion 12 in a dry method to obtain a defibrated material MB. The defibration is a process of unraveling the raw material piece MS in a state in which a plurality of fibers are bound into one or a small number of fibers. The dry method refers to performing a process such as defibration in the air, instead of in a liquid. For example, the defibrated material MB contains components derived from the raw material MA, such as fibers contained in the raw material MA, resin particles, coloring agents such as ink or toner, anti-smearing materials, and paper strength enhancers.

The defibration portion 20 is, for example, a mill which includes a tube-shaped stator 22 and a rotor 24 which rotates inside the stator 22, and defibrates the raw material piece MS by holding the raw material piece MS between the stator 22 and the rotor 24. The defibrated material MB is sent to the sorting portion 40 through a pipe.

The sorting portion 40 includes a drum portion 41 and a housing portion 43 which accommodates the drum portion 41. The drum portion 41 is a sieve having openings such as a net, a filter, and a screen, and is rotated by power of a motor (not illustrated). The defibrated material MB unravels inside the rotating drum portion 41 and descends through the opening of the drum portion 41. Among components of the defibrated material MB, a component does not pass through the opening of the drum portion 41 is transported to the hopper 9 through a pipe 8.

The first web forming portion 45 includes an endless-shaped mesh belt 46 having a large number of openings. The first web forming portion 45 manufactures a first web W1 by accumulating fibers and the like descending from the drum portion 41 on the mesh belt 46. Among the components descending from the drum portion 41, those smaller than the opening of the mesh belt 46 pass through the mesh belt 46 and are suctioned and removed by a suction portion 48. Thus, among the components of the defibrated material MB, short fibers, resin particles, ink, toner, anti-smearing agents, and the like, which are not appropriate for manufacturing the sheet S, are removed.

A humidifier 77 is disposed on a movement path of the mesh belt 46, and the first web W1 accumulated on the mesh belt 46 is humidified by mist-like water or high-humidity air.

The first web W1 is transported by the mesh belt 46 and comes into contact with the rotator 49. The rotator 49 divides the first web W1 by a plurality of blades to obtain a material MC. The material MC is transported to the mixing portion 50 through a pipe 54.

The mixing portion 50 includes an additive supply portion 52 which adds an additive material AD to the material MC, and a mixing blower 56 which mixes the material MC and the additive material AD. The additive material AD includes a binding material such as a resin for binding a plurality of fibers, and may include a colorant, an aggregation inhibitor, a flame retardant, and the like. The mixing blower 56 generates airflow in the pipe 54 to which the material MC and the additive material AD are transported, mixes the material MC and the additive material AD, and transports a mixture MX to the dispersion portion 60.

The dispersion portion 60 includes a drum portion 61 and a housing 63 which accommodates the drum portion 61. The drum portion 61 is a cylinder-shaped sieve having the same configuration as the drum portion 41, and is driven by a motor (not illustrated) to rotate. By the rotation of the drum portion 61, the mixture MX unravels and descends into the housing 63.

The second web forming portion 70 includes an endless-shaped mesh belt 72 having a large number of openings. The second web forming portion 70 manufactures a second web W2 by accumulating the mixture MX descending from the drum portion 61 on the mesh belt 72. Among components of the mixture MX, those smaller than the opening of the mesh belt 72 pass through the mesh belt 72 and are suctioned by a suction portion 76.

A humidifier 78 is disposed on a movement path of the mesh belt 72, and the second web W2 accumulated on the mesh belt 72 is humidified by mist-like water or high-humidity air.

The second web W2 is peeled off from the mesh belt 72 by the web transport portion 79, and is transported to the processing portion 80. The processing portion 80 includes a pressing portion 82 and a heating portion 84. The pressing portion 82 holds the second web W2 between a pair of pressing rollers and presses the second web W2 with a predetermined nip pressure to form a pressurized sheet SS1.

The heating portion 84 applies heat across the pressurized sheet SS1 by a pair of heating rollers. Thus, fibers contained in the pressurized sheet SS1 are bound by resin contained in the additive material AD, and a heated sheet SS2 is formed. The heated sheet SS2 is transported to the cutting portion 90.

The cutting portion 90 cuts the heated sheet SS2 in a direction crossing a transport direction F and/or in a direction along the transport direction F, and manufactures a sheet S having a predetermined size. The sheet S is stored in a discharge portion 96.

The sheet manufacturing apparatus 100 includes a control apparatus 110. The control apparatus 110 controls each portion of the sheet manufacturing apparatus 100 including the defibration portion 20, the additive supply portion 52, the mixing blower 56, the dispersion portion 60, the second web forming portion 70, the processing portion 80, and the cutting portion 90 so as to execute a method of manufacturing the sheet S. Further, the control apparatus 110 may control the operations of the supply portion 10, the sorting portion 40, the first web forming portion 45, and the rotator 49.

The sheet manufacturing apparatus 100 corresponds to an example of a fiber transport apparatus of the present disclosure.

1-2. Configuration of Storage Portion

Figure 2:
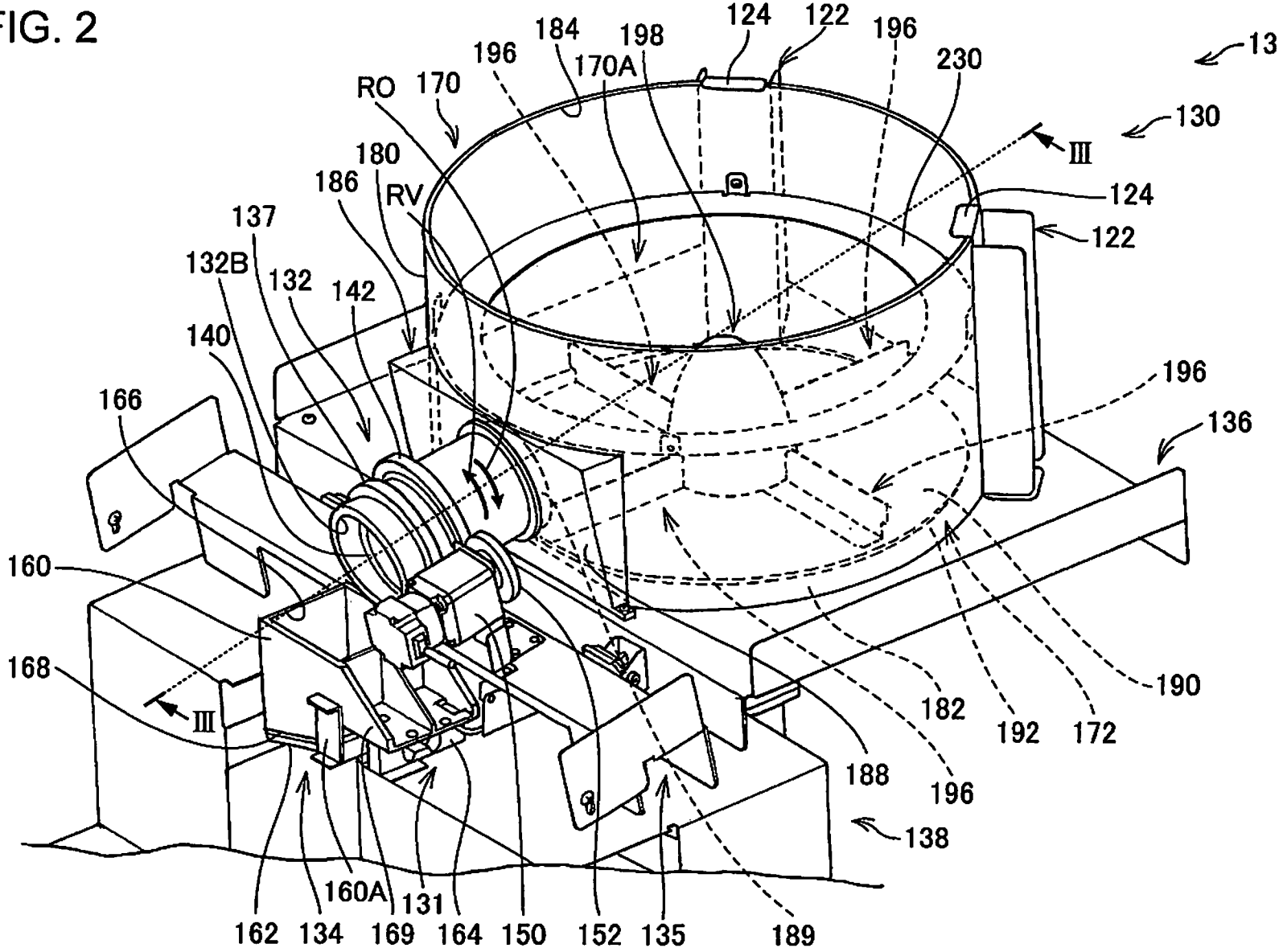
FIG. 2 is a perspective view of a storage portion.
Figure 3:
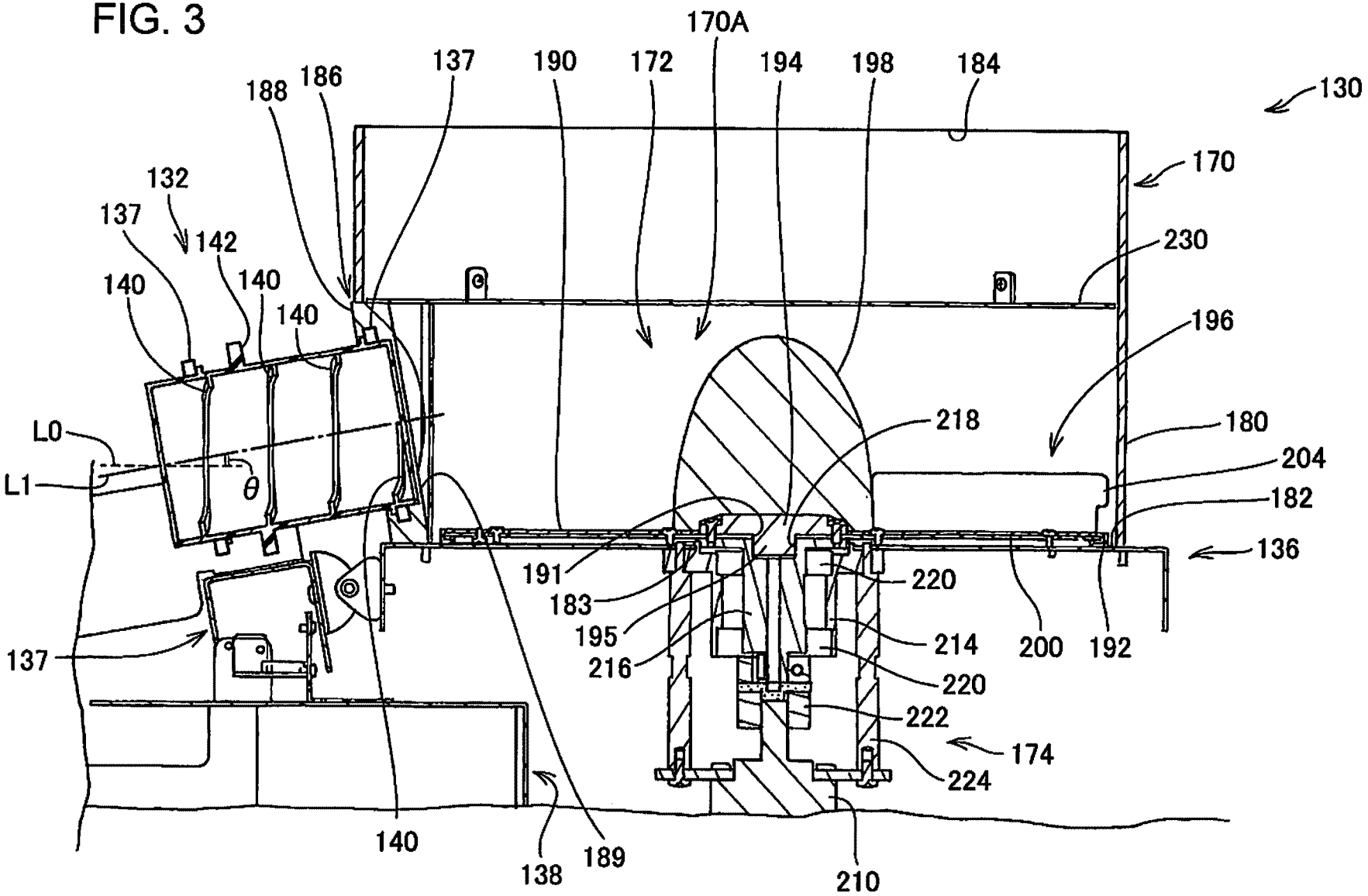
FIG. 3 is a longitudinal cross-sectional view taken along line in FIG. 2.

FIG. 2 is a perspective view of the storage portion 13. FIG. 3 is a longitudinal cross-sectional view taken along line III-III in FIG. 2. In FIG. 3, a measurement portion 134 is not illustrated.

The storage portion 13 includes a stirring apparatus 130, a discharge pipe 132, and the measurement portion 134.

The stirring apparatus 130 has a function of temporarily storing the raw material pieces MS transported from the hopper 9 and a function of stirring the stored raw material pieces MS. The stirring apparatus 130 includes a case 170, a rotator 172, and a drive mechanism 174, as illustrated in FIG. 3.

The hopper 9 is located above an opening portion 184 of the case 170, and the raw material pieces MS are put into the case 170 from the hopper 9 through the opening portion 184.

The case 170 is formed such that a side wall 180, which is a cylinder-shaped member, is mounted on a mounting table 136, and accommodates the raw material pieces MS. A bottom portion of the side wall 180 is open and clogged by an upper surface of the mounting table 136. That is, the upper surface of the mounting table 136 forms a bottom surface 182 of the case 170.

The side wall 180 is fixed to the mounting table 136 by a plurality of support members 122. As illustrated in FIG. 2, the support member 122 is a columnar member having a C-shaped cross-section, and is erected on the upper surface of the mounting table 136. A claw portion 124 is provided at an upper end of the support member 122, and the claw portion 124 is engaged with an upper end of the side wall 180, so that the side wall 180 is fixed to the mounting table 136. In the present embodiment, a configuration in which four support members 122 are arranged at equal intervals along the outer periphery of the case 170 is illustrated. FIG. 2 illustrates only some of the support members 122. The side wall 180 may be fixed to the mounting table 136 by an adhesive or the like without using the support member 122. Further, the support member 122 and the side wall 180 may be fixed by an adhesive.

An annular overhang 230 is provided on the inner peripheral surface of the side wall 180. The overhang 230 regulates winding of the raw material pieces MS so that the raw material pieces MS stirred inside the stirring apparatus 130 do not overflow from the opening portion 184. A width and a height position of the overhang 230 can be appropriately changed in accordance with a shape or a size and a processing speed of the stirring apparatus 130.

A discharge portion 186 is provided on the side wall 180. The discharge portion 186 corresponds to an example of a coupling portion. The discharge portion 186 is a hollow overhang portion provided from a lower portion of the side wall 180 toward the outside of the case 170. The measurement portion 134 is disposed outside the case 170 so as to face the discharge portion 186.

The discharge portion 186 includes an inclined surface 188 which is inclined downward to face the measurement portion 134. An outlet 189 is open on the inclined surface 188, and the raw material pieces MS can be discharged from the inside of the case 170 through the outlet 189. The discharge pipe 132 is coupled to the outlet 189.

The rotator 172 which stirs the raw material pieces MS is disposed at a bottom portion of the case 170. The rotator 172 corresponds to an example of a stirring portion. The rotator 172 is rotatably installed with respect to the bottom surface 182, and includes a rotating portion 190, a plurality of blades 196, and a protrusion member 198.

The rotating portion 190 is a disk-shaped member which is disposed so as to overlap with the bottom surface 182, and a boundary between the rotating portion 190 and the bottom surface 182 is sealed by a sealing member 192. The sealing member 192 suppresses a situation in which the raw material pieces MS enter between the rotating portion 190 and the bottom surface 182, are compressed, and becomes a lump. The sealing member 192 is formed of, for example, a resin such as polyacetal.

A center hole 191, which is a through-hole, is provided at a rotation center of the rotating portion 190. Further, a bottom surface hole 183, which is a through-hole, is provided at a position at which the bottom surface 182 overlaps with a center of the rotating portion 190, on the bottom surface 182. A coupling member 194 which penetrates through the center hole 191 and reaches an inside of the bottom surface hole 183 is disposed in the rotating portion 190. The coupling member 194 is fixed to the rotating portion 190.

The rotator 172 is coupled to the drive mechanism 174, and is rotated by power of the drive mechanism 174. The drive mechanism 174 includes a stirring motor 210, a housing member 214, a drive shaft 216, and the coupling member 194, and is disposed below the mounting table 136. The stirring motor 210 corresponds to an example of a first driving portion. The housing member 214 is a cylinder-shaped housing which accommodates the drive shaft 216, and is coupled to a lower surface of the mounting table 136.

The drive shaft 216 is an output shaft of the stirring motor 210, passes through an inside of the housing member 214, and is coupled to an insertion portion 195 formed below the coupling member 194 inside the bottom surface hole 183. The drive shaft 216 is rotatably supported by the housing member 214 by two bearings 220.

With this configuration, when the stirring motor 210 operates and the drive shaft 216 rotates, the rotator 172 rotates at the bottom portion of the case 170 together with the drive shaft 216.

The plurality of blades 196 are fixed to an upper surface of the rotating portion 190. The blade 196 is disposed so as to extend radially from the rotation center of the rotating portion 190. In the present embodiment, the four blades 196 are arranged in the rotator 172, and the respective blades 196 are arranged at predetermined intervals in a circumferential direction of the rotating portion 190. A flange 200 is formed at a lower end of the blade 196, and the flange 200 is fixed in surface contact with the rotating portion 190. With this configuration, there is an effect of preventing the raw material pieces MS from entering between the blade 196 and the rotating portion 190. Although an example in which the blade 196 is erected substantially vertically is illustrated, the blade 196 may be installed at an angle which is an acute angle or an obtuse angle from the upper surface of the rotating portion 190.

One end of the blade 196 is close to the coupling member 194 near a center of the rotator 172. The other end of the blade 196 is located at a position close to the periphery of the rotating portion 190. For this reason, when the rotator 172 rotates, the raw material pieces MS are stirred over a wider range in a radial direction of the case 170.

A protrusion piece 204 which protrudes in a radial direction of the rotating portion 190 is formed at an end of the blade 196 at an outer peripheral portion of the rotator 172. The protrusion piece 204 is disposed at an overlapping position with the outlet 189 in a height direction of the case 170. The protrusion piece 204 acts to push the raw material piece MS to the outlet 189 while the rotator 172 rotates.

The protrusion member 198 is disposed at a rotation center of the upper surface of the rotating portion 190. The protrusion member 198 is a semi-elliptical sphere or a hemispherical member, and covers the coupling member 194. In addition, an end of the blade 196 and the coupling member 194 are coupled such that there is no gap or the gap is small. A height of the protrusion member 198 may be higher than a height of the blade 196, and in the present embodiment, is approximately half a height of the side wall 180.

The protrusion member 198 closes a space at the rotation center of the rotating portion 190, and suppresses the accumulation of the raw material pieces MS in this space. The raw material piece MS located at the rotation center of the rotating portion 190 is not easily affected by centrifugal force due to the rotation, and does not contact the blade 196. For this reason, when the rotating portion 190 is rotated, the raw material piece MS tends to stay at the rotation center. By disposing the protrusion member 198 at the rotation center of the rotating portion 190 to close the space of the rotation center, stagnation of the raw material pieces MS can be suppressed, and the raw material pieces MS can be effectively stirred in the case 170. A shape of the protrusion member 198 is not limited to the hemisphere or the semi-elliptic sphere, and may be a cone such as a cone or a pyramid, or a cone having a spherical tip.

Figure 4:
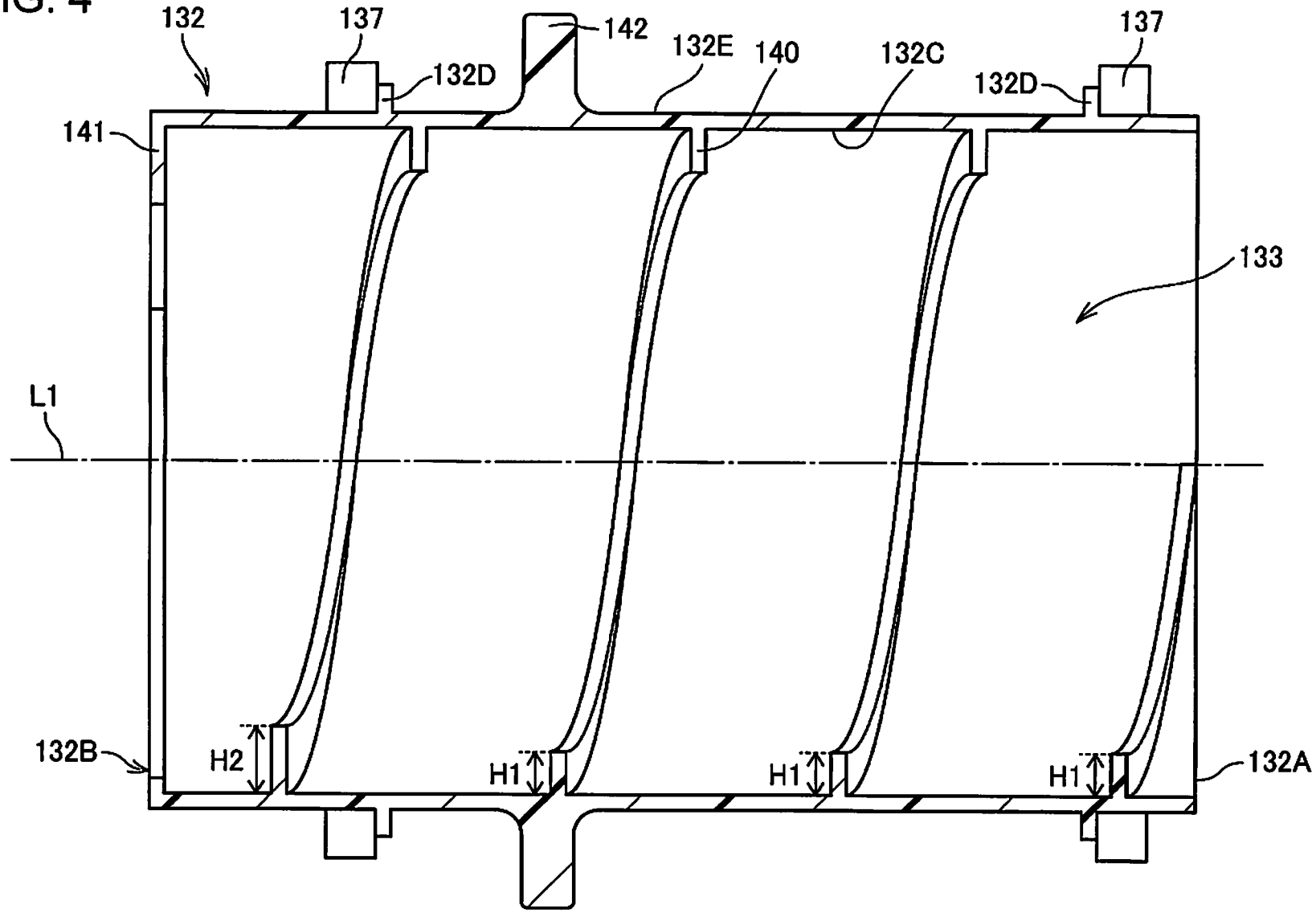
FIG. 4 is a cross-sectional view of a discharge pipe.

FIG. 4 is a cross-sectional view of the discharge pipe 132.

The discharge pipe 132 is a hollow tubular member, and transports the raw material pieces MS stored in the stirring apparatus 130 toward the measurement portion 134. In the present embodiment, the discharge pipe 132 is a straight pipe having a circular cross-section, and a virtual axis passing through a center of the cross section is defined as a central axis L1. The discharge pipe 132 corresponds to an example of a rotator. The discharge pipe 132 corresponds to an example of a tube. The central axis L1 corresponds to an example of an axis. The discharge pipe 132 according to the present embodiment is made of ABS resin, but may be made of another material. Here, the ABS is an abbreviation of acrylonitrile butadiene styrene.

Both ends of the discharge pipe 132 are open, an opening at one end is an inlet 132A, and an opening at the other end is an outlet 132B. The inlet 132A is coupled to the discharge portion 186 of the stirring apparatus 130, communicates with an internal space 170A of the case 170, and the outlet 132B opens at a position close to the measurement portion 134. The discharge pipe 132 functions as a transport path 133 which transports the raw material pieces MS from the internal space 170A to the measurement portion 134.

The discharge pipe 132 is installed horizontally so that the outlet 132B is at the same height position as the inlet 132A, or is inclined so that the outlet 132B is at a lower position than the inlet 132A. The inclination of the discharge pipe 132 is specified by an angle θ of the central axis L1 from a horizontal line L0, and for example, the angle θ is appropriately within a range equal to or more than 0° and equal to or less than 15°, and appropriately 5° in particular.

An annular rib 141 is formed at an edge of the outlet 132B. According to the formation of the rib 141, a diameter of the outlet 132B is reduced. The rib 141 suppresses discharge of the raw material pieces MS from the outlet 132B, and facilitates adjustment of the amount of raw material pieces MS discharged from the outlet 132B.

Spiral members 140 are arranged inside the discharge pipe 132.

Figure 5:
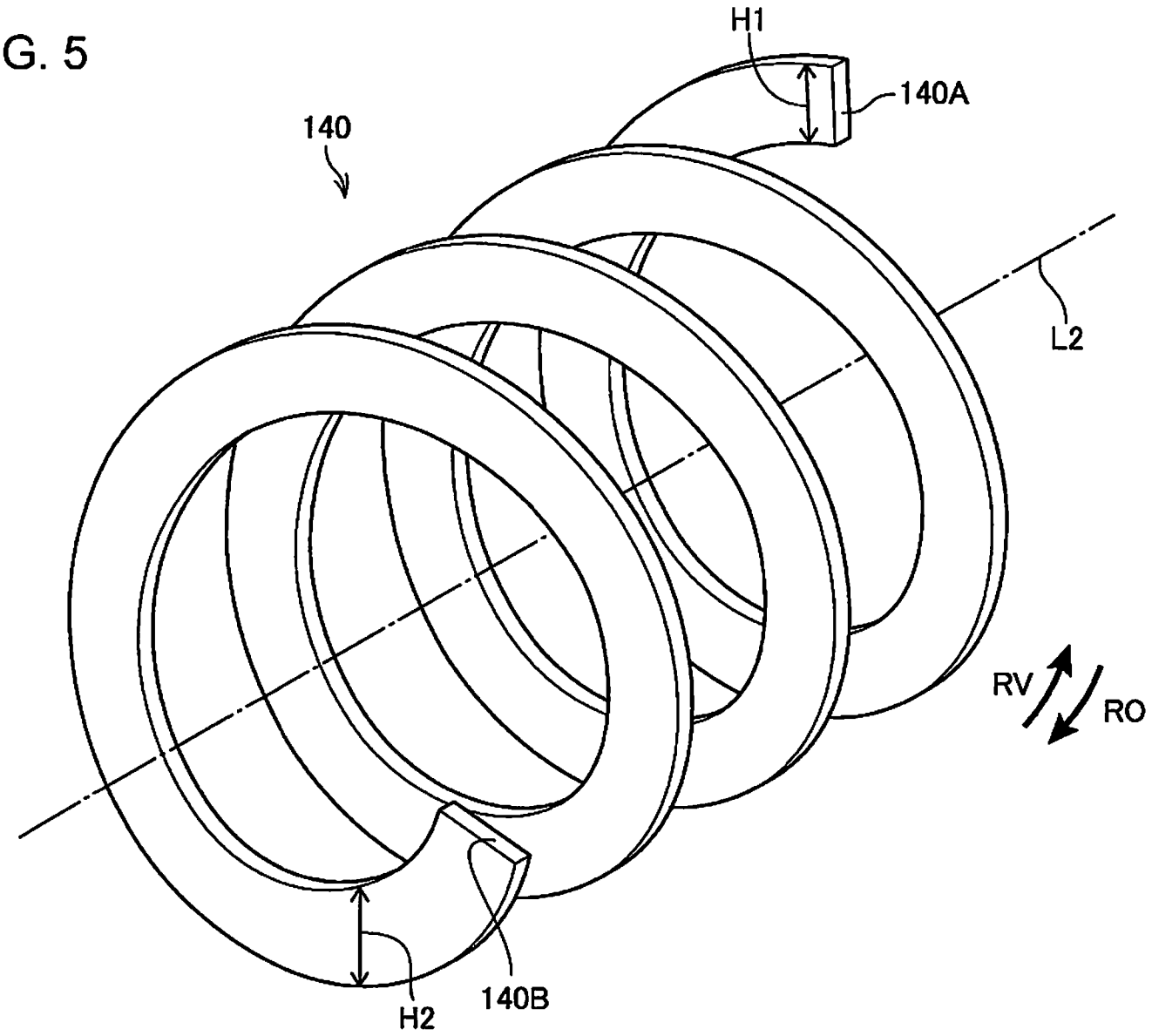
FIG. 5 is a perspective view of a spiral member.

FIG. 5 is a perspective view of the spiral member 140.

The spiral member 140 has a shape in which a thin plate having a rectangular cross-section draws a spiral. The spiral member 140 illustrated in FIG. 5 forms the spiral having three and a half turns at an equal pitch, but the number of turns and the pitch of the spiral member 140 can be optionally changed. Here, the pitch refers to a length of the spiral member 140 per one turn in a direction along an axis L2. The axis L2 is a virtual axis passing through a center of a circumference of the spiral member 140, and ends of the spiral member 140 in the direction along the axis L2 are referred to as an end 140A and an end 140B. A width of the spiral member 140 may be uniform throughout, but in the present embodiment, a width H2 of the spiral member 140 in one turn including the end 140B is larger than a width H1 of the spiral member 140 in the other turn, and the amount of raw material pieces MS discharged from the outlet 132B can be easily adjusted.

The spiral member 140 is disposed along an inner peripheral surface 132C of the discharge pipe 132. The spiral member 140 may be in close contact with the inner peripheral surface 132C without any gap. The axis L2 of the spiral member 140 coincides with the central axis L1 of the discharge pipe 132, or may be parallel to the central axis L1. In the present embodiment, the axis L2 of the spiral member 140 coincides with the central axis L1 of the discharge pipe 132. The end 140A of the spiral member 140 is located near the inlet 132A of the discharge pipe 132, and the end 140B is located near the outlet 132B. The end 140A and the inlet 132A may be separated, and the end 140B and the outlet 132B may be separated.

By disposing the spiral member 140 inside the discharge pipe 132, a protrusion in a spiral shape is formed at the inner peripheral surface 132C. A height of the protrusion formed by the spiral member 140 is the width H1 and the width H2 of the spiral member 140. For this reason, in an internal space of the discharge pipe 132, a height H2 of the protrusion at a position near the outlet 132B is higher than a height H1 of the protrusion at a position near the inlet 132A.

The discharge pipe 132 is rotatably supported by bearings 137 and 137. Annular bearing support portions 132D and 132D are attached to an outer peripheral surface 132E of the discharge pipe 132, and the bearing support portions 132D are 132D respectively fit into the bearings 137 and 137. One bearing 137 is fixed to the discharge portion 186, and the other bearing 137 is fixed to a pipe support member 135 provided on a side surface of the mounting table 136. Thus, the discharge pipe 132 is supported at a plurality of positions in a longitudinal direction.

A driven gear 142 is provided on the outer peripheral surface 132E of the discharge pipe 132 between the bearing support portions 132D and 132D. The driven gear 142 is a spur gear disposed or formed at the outer peripheral surface 132E in a circumferential direction. The driven gear 142 is coupled to a transport motor 150 installed on an upper surface of the pipe support member 135. Here, the transport motor 150 corresponds to an example of a second driving portion. A drive gear 152 is attached to a drive shaft of the transport motor 150, and the drive gear 152 meshes with the driven gear 142. When the transport motor 150 rotates the drive shaft, the discharge pipe 132 rotates on the central axis L1. The transport motor 150 can rotate in a forward direction and in a reverse direction as described below, and can control a rotation direction of the discharge pipe 132 by controlling a rotation direction of the transport motor 150. Here, the rotation direction of the discharge pipe 132 is a forward direction RO or a reverse direction RV.

A transport apparatus 131 which transports the raw material pieces MS is configured to include the discharge pipe 132, the spiral member 140, the driven gear 142, the transport motor 150, the drive gear 152, and the like.

The discharge pipe 132 rotates at a speed corresponding to a rotation speed of the transport motor 150. The rotation speed of the discharge pipe 132 affects the transport amount of raw material pieces MS transported by the discharge pipe 132. Therefore, the control apparatus 110 to be described below controls rotation of the transport motor 150 such that the rotation speed of the discharge pipe 132 is within an appropriate range.

When the rotation speed of the discharge pipe 132 is too low, that is, when the number of revolutions per unit time is small, an action of lifting the raw material pieces MS inside the discharge pipe 132 is weak and an effect of dropping and unraveling by gravity is small, so that it is difficult to break the lump-shaped raw material pieces MS. Further, since the rotation speed of the discharge pipe 132 is low, the raw material pieces MS are less likely to move in a direction of the central axis L1, and the amount of raw material pieces MS transported by the discharge pipe 132 is reduced. On the other hand, when the rotation speed of the discharge pipe 132 is too high, that is, when the number of revolutions per unit time is large, the raw material pieces MS inside the discharge pipe 132 are in a state of being attached to the inner peripheral surface 132C by centrifugal force, and is not dropped by gravity from the state of being lifted inside the discharge pipe 132, so that it is difficult to transport the raw material pieces MS. Therefore, the raw material pieces MS are less likely to move in the direction of the central axis L1, and the amount of raw material pieces MS transported by the discharge pipe 132 is small.

Therefore, by adjusting the rotation speed of the discharge pipe 132 within the appropriate range, the raw material pieces MS can be stably transported while unraveling, inside the discharge pipe 132.

The rotation speed of the discharge pipe 132 is adjusted, for example, within a range equal to or more than 45 rpm (revolutions/min) and equal to or less than 105 rpm. In particular, a speed within a range equal to or more than 50 rpm and equal to or less than 95 rpm is appropriate, and the raw material pieces MS can be transported effectively. In the present embodiment, as an example, the discharge pipe 132 is rotated at 75 rpm.

In addition, the rotation direction of the discharge pipe 132 affects the transport amount of raw material pieces MS transported by the discharge pipe 132. Therefore, the control apparatus 110 to be described below changes the rotation direction of the transport motor 150 so that the rotation speed of the discharge pipe 132 is within the appropriate range.

Figure 6:
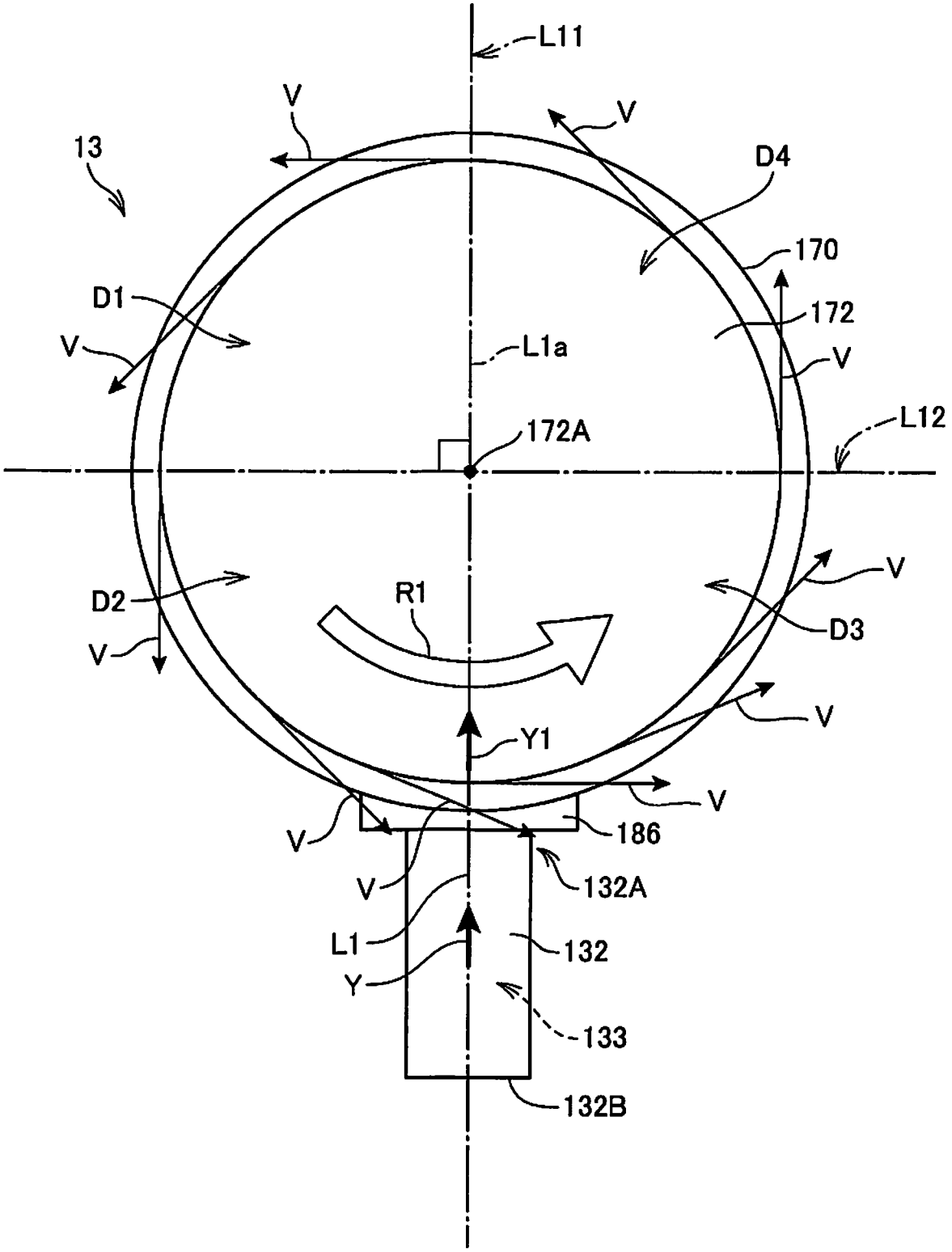
FIG. 6 is a schematic diagram corresponding to a plan view of the storage portion.

FIG. 6 is a schematic diagram corresponding to a plan view of the storage portion 13.

In the plan view of the storage portion 13 illustrated in FIG. 6, a first virtual straight line L11 passing through a rotation center 172A of the rotator 172 and a second virtual straight line L12 which is orthogonal to the first virtual straight line L11 and passes through the rotation center 172A of the rotator 172 divide a rotation region of the rotator 172 into four. That is, as illustrated in FIG. 6, the rotation region of the rotator 172 is divided into regions D1, D2, D3, and D4 by the first virtual straight line L11 and the second virtual straight line L12. Meanwhile, the first virtual straight line L11 and the second virtual straight line L12 are arranged so that the second virtual straight line L12 is orthogonal to an extension axis L1*a*. Here, the extension axis L1*a* is a half-linear virtual line extending from the central axis L1 of the discharge pipe 132 to the outside in an extension direction Y1 of the discharge pipe 132. The extension axis L1*a* corresponds to an example of an extension virtual line.

In the present embodiment, a position of the extension axis L1*a* coincides with a position of the first virtual straight line L11, and the inlet 132A of the discharge pipe 132 faces the two regions D2 and D3 on the discharge pipe 132 side than the second virtual straight line L12, among the four-divided regions D1-D4. In the present embodiment, the inlet 132A of the discharge pipe 132 is disposed on a tangent of the outer peripheral portion of the rotator 172.

Here, in the present embodiment, the rotator 172 has a circular shape in plan view. When the rotator 172 rotates, a direction of a velocity vector V at the outer peripheral portion of the rotator 172 at each position in a circumferential direction is a tangential direction of the outer peripheral portion of the rotator 172, and faces downstream in a rotation direction of the rotator 172. In the vicinity of the inlet 132A, that is, on the discharge pipe 132 side of the second virtual straight line L12, the velocity vector V tends to have a component in a direction crossing the central axis L1 or the extension axis L1*a* of the discharge pipe 132 in a moving direction according to a rotation direction R1.

Therefore, when the rotator 172 rotates in the counterclockwise rotation direction R1 in plan view, in the vicinity of the inlet 132A, the velocity vector V of the rotator 172 tends to have a component in a direction crossing the central axis L1 or the extension axis L1*a* from the left to the left. For this reason, the raw material piece MS which moves by receiving a force from the rotator 172 tends to enter the downstream in the rotation direction R1 of the rotator 172 from the central axis L1, that is, the right side of the central axis L1, inside the discharge pipe 132.

Figure 7:
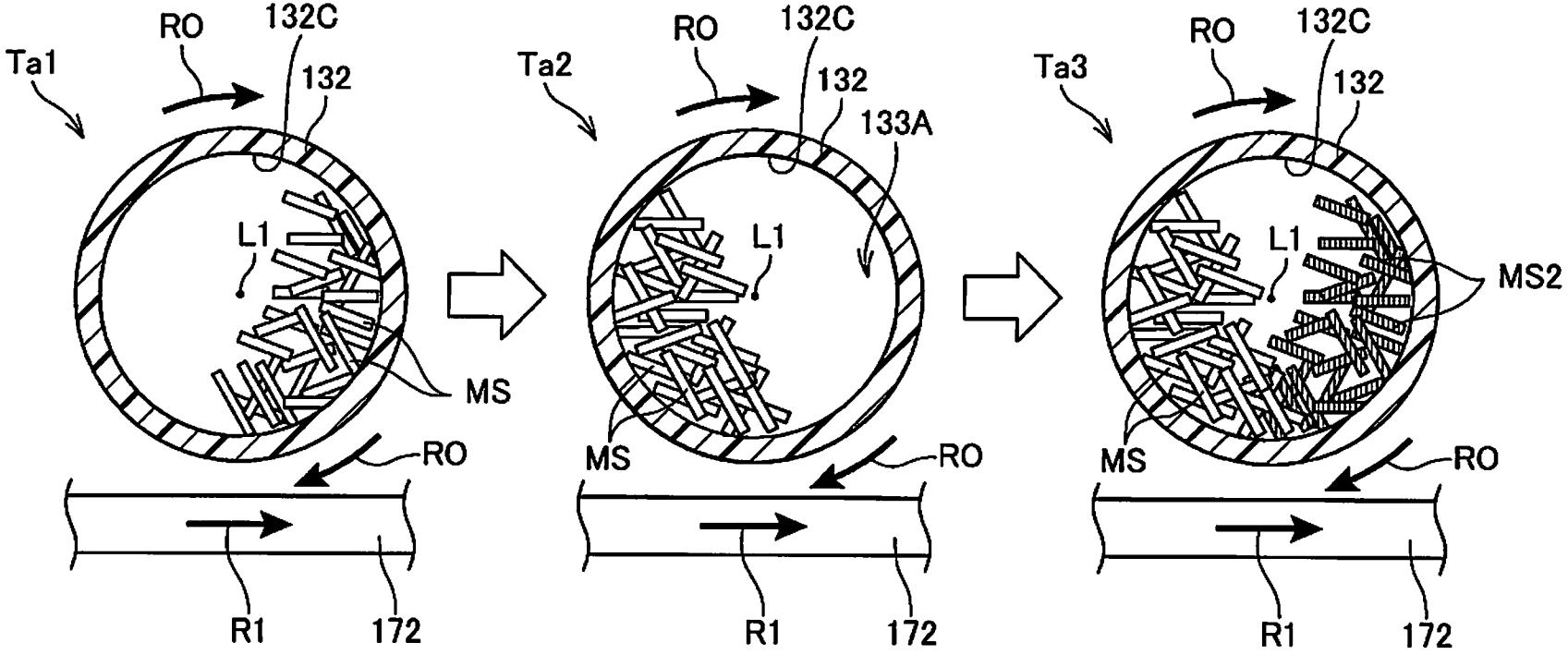
FIG. 7 is an explanatory diagram illustrating movement of raw material pieces when being rotated in a forward direction.
Figure 8:
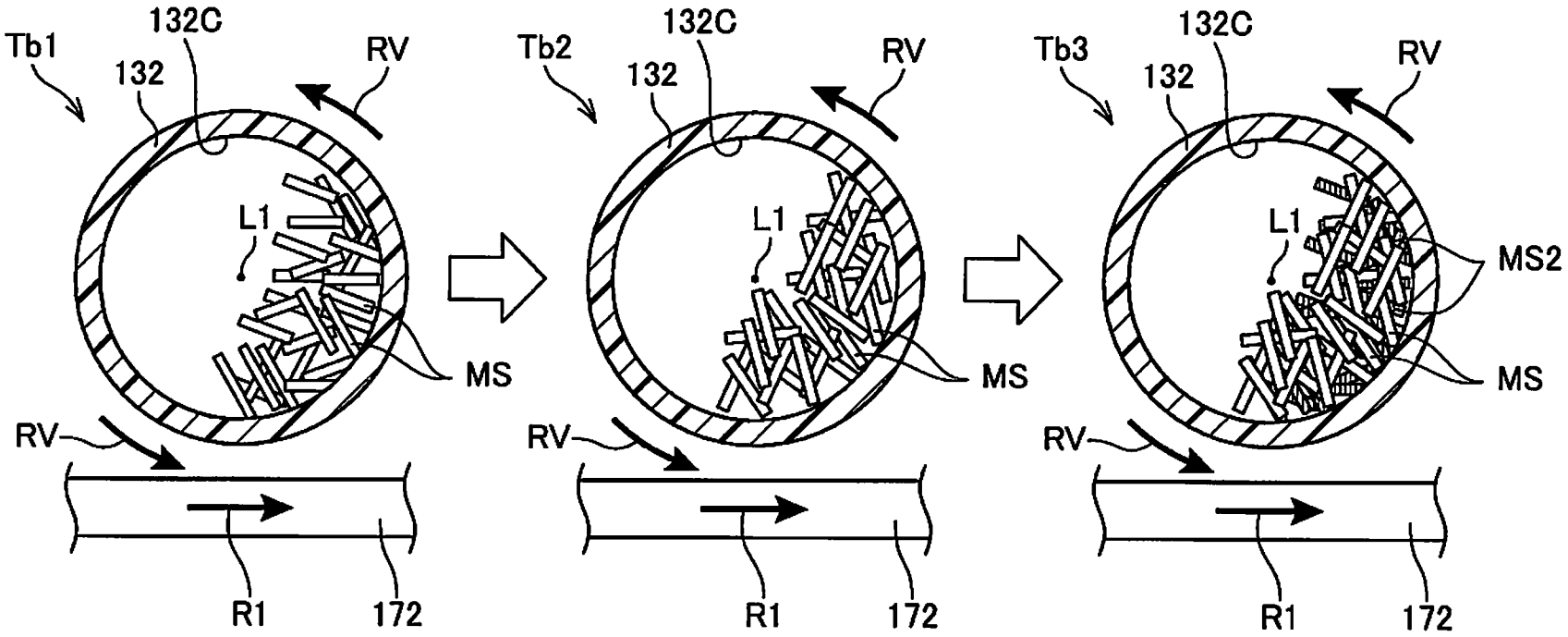
FIG. 8 is a schematic diagram illustrating the movement of the raw material pieces when being rotated in a reverse direction.

FIG. 7 is an explanatory diagram illustrating movement of the raw material pieces MS when the inlet 132A is viewed in an arrow direction Y in FIG. 6 when being rotated in the forward direction RO. FIG. 8 is a schematic diagram illustrating the movement of the raw material pieces MS when the inlet 132A is viewed in the arrow direction Y in FIG. 6 when being rotated in the reverse direction RV.

As illustrated by an arrow Ta1 in FIG. 7, when the rotator 172 rotates in the counterclockwise rotation direction R1, the raw material pieces MS tend to flow on the right into the discharge pipe 132. When the discharge pipe 132 rotates in the forward direction RO, as illustrated by an arrow Ta2 in FIG. 7, the raw material piece MS flowing on the right tend to move to the left through the lower side of the central axis L1 due to frictional force with the inner peripheral surface 132C of the discharge pipe 132. Therefore, the space 133A is easily generated on the right side of the central axis L1. As illustrated by an arrow Ta3, new raw material pieces MS2 tend to flow from the case 170 into the space 133A generated on the right side of the central axis L1.

On the other hand, when the discharge pipe 132 rotates in the reverse direction RV, as illustrated by arrows Tb1 and Tb2 in FIG. 8, the raw material piece MS which flows on the right side into the discharge pipe 132 is easily held on the right side of the central axis L1 by frictional force with the inner peripheral surface 132C of the discharge pipe 132. For this reason, as illustrated by an arrow Tb3, even when the new raw material piece MS2 tries to enter the discharge pipe 132 from the right side of the central axis L1, the inflow is easily regulated by the raw material piece MS.

Here, as illustrated in FIG. 7, the forward direction RO of the present embodiment is a direction such that when the inlet 132A side is viewed from the outlet 132B side, a portion below the central axis L1 of the discharge pipe 132 moves in an opposite direction of the counterclockwise rotation direction R1 of the rotator 172. In addition, as illustrated in FIG. 8, the reverse direction RV of the present embodiment is a direction such that when the inlet 132A side is viewed from the outlet 132B side, the portion below the central axis L1 of the discharge pipe 132 moves in the counterclockwise rotation direction R1 of the rotator 172.

That is, depending on a rotation state of the rotator 172 inside the case 170, by moving the portion below the central axis L1 of the discharge pipe 132 in the rotation direction R1 of the rotator 172 or in an opposite direction of the rotation direction R1, a rotation state of the discharge pipe 132 is switched. Thus, it is possible to allow or regulate the flow of the new raw material piece MS2 into the discharge pipe 132. Therefore, as described below, the control apparatus 110 of the present embodiment switches the rotation direction of the discharge pipe 132 between the forward direction RO and the reverse direction RV, so that it is possible to adjust the discharge amount of raw material pieces MS discharged from the outlet 132B.

As illustrated in FIG. 2, the measurement portion 134 is disposed below the outlet 132B of the discharge pipe 132. The measurement portion 134 includes a reception portion 160 which stores the raw material pieces MS discharged from the outlet 132B, and a load cell 164 which measures a weight of the reception portion 160. The reception portion 160 corresponds to an example of a container which accommodates the raw material pieces MS. The load cell 164 is fixed to a support 138. The load cell 164 measures a weight of the raw material pieces MS stored in the reception portion 160 by measuring the weight of the reception portion 160, and corresponds to an example of a weight measurement portion.

The reception portion 160 is a hollow box-shaped member having an open upper surface. Since the outlet 132B is located above an upper opening portion 166 of the reception portion 160, the raw material pieces MS fall from the outlet 132B and are stored in the reception portion 160.

A side surface of the reception portion 160 is provided with a protrusion portion 169 which protrudes sideways, and a bottom portion of the protrusion portion 169 is in contact with the load cell 164. For this reason, a load is applied to the load cell 164 from the reception portion 160 via the protrusion portion 169.

A bottom opening portion 168 is open on a bottom surface of the reception portion 160, and a closing member 162 is attached to the bottom opening portion 168.

The closing member 162 is rotatably attached by a shaft 160A. The closing member 162 is rotatable between a closing position for closing the bottom opening portion 168 and an opening position for opening the bottom opening portion 168 by power of an opening and closing motor 165 to be described below. That is, the bottom opening portion 168 of the reception portion 160 is opened and closed by an operation of the opening and closing motor 165. When the bottom opening portion 168 is opened, the raw material pieces MS stored in the reception portion 160 are discharged and sent to the defibration portion 20. The bottom opening portion 168 may be opened and closed by a sliding plate member.

The load cell 164 is a sensor which measures a weight or a force such as torque. In the configuration illustrated in FIG. 2, the load cell 164 measures a force applied via the protrusion portion 169 and outputs a signal corresponding to the measured value to the control apparatus 110.

1-3. Configuration of Control System of Sheet Manufacturing Apparatus

Figure 9:
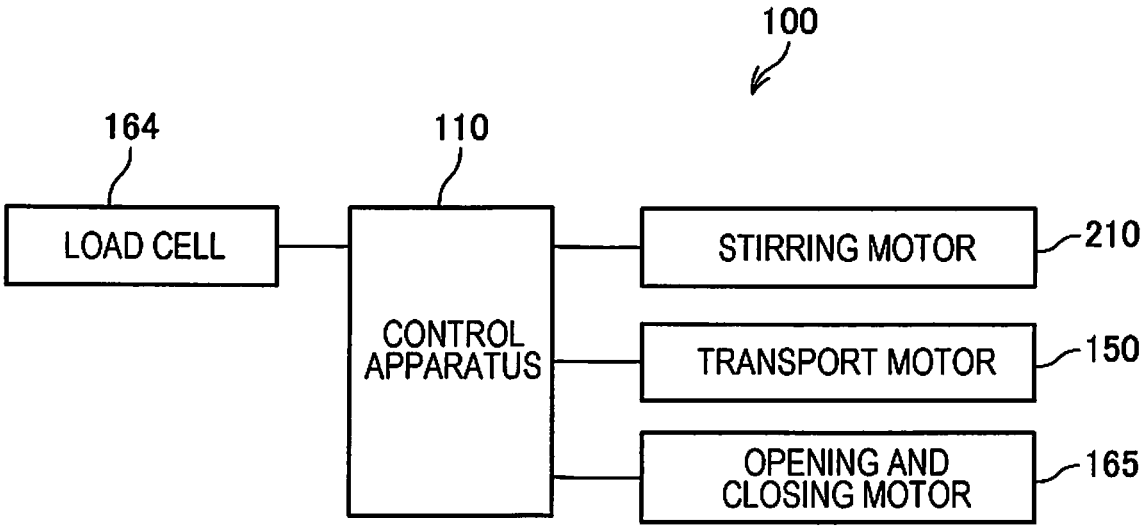
FIG. 9 is a block diagram illustrating a main configuration of a control system of the sheet manufacturing apparatus.

FIG. 9 is a block diagram illustrating a main configuration of a control system of the sheet manufacturing apparatus 100.

The control apparatus 110 manufactures the sheet S by controlling each portion of the sheet manufacturing apparatus 100 based on an input operation of an operation portion (not illustrated) and detected values obtained by various sensors included in the sheet manufacturing apparatus 100.

The control apparatus 110 includes, for example, a processor such as a CPU or a microcomputer, and controls each portion of the sheet manufacturing apparatus 100 by executing a program. The control apparatus 110 may be configured to include a ROM, a RAM, other signal processing circuits, and the like in addition to the processor described above, and may be configured by an SoC in which these are integrated. The control apparatus 110 executes processes by cooperating with the hardware and the software, for example, the CPU reads out the program stored in the ROM into the RAM to execute the process, or also executes a signal process in the signal processing circuit to execute the process. Further, the control apparatus 110 may be configured to include an ASIC and execute various types of processes by using functions mounted on hardware, such as a configuration in which the process is executed by using a function mounted on the ASIC.

Here, the ROM is an abbreviation of read only memory. The RAM is an abbreviation of random access memory. The CPU is an abbreviation of central processing unit. The SoC is an abbreviation of system-on-a-chip. The ASIC is an abbreviation of application specific integrated circuit.

FIG. 9 illustrates the load cell 164 among sensors coupled to the control apparatus 110. In addition, the stirring motor 210, the transport motor 150, and the opening and closing motor 165 are illustrated as driving portions coupled to the control apparatus 110. Further, various sensors which control operations of the sheet manufacturing apparatus 100 and various driving portions which operate the sheet manufacturing apparatus 100 are coupled to the control apparatus 110, but these are not illustrated.

A signal indicating the measured value of the weight of the reception portion 160 is input from the load cell 164 to the control apparatus 110. The control apparatus 110 controls driving and stopping of the stirring motor 210. The control apparatus 110 causes the discharge pipe 132 to rotate in the forward direction and in the reverse direction by controlling driving and stopping of the transport motor 150 and switching of the rotation direction of the transport motor 150. The control apparatus 110 controls driving and stopping of the opening and closing motor 165 and a rotation direction of the opening and closing motor 165, and operates the closing member 162 to open and close the bottom opening portion 168.

When detecting an operation of instructing a start of manufacturing of the sheet S, the control apparatus 110 initializes each portion of the sheet manufacturing apparatus 100 and starts the operation. At this time, the control apparatus 110 starts operations of the stirring motor 210 and the transport motor 150 to start stirring and transport of the raw material pieces MS. Further, when the measured value of the load cell 164 reaches a set target value, the control apparatus 110 operates the opening and closing motor 165 to open the bottom opening portion 168.

The control apparatus 110 has a timing function, and counts a time until the measured value of load cell 164 reaches the target value. The control apparatus 110 controls the rotation direction of the transport motor 150 by comparing the counted time with a preset threshold value.

The control apparatus 110 corresponds to an example of a control portion of the present disclosure.

1-4. Operation of Sheet Manufacturing Apparatus

When the sheet manufacturing apparatus 100 is started, the control apparatus 110 drives the stirring motor 210 of the stirring apparatus 130 of the storage portion 13 to rotate the rotator 172. Further, the control apparatus 110 drives the transport motor 150 of the transport apparatus 131 of the storage portion 13 to rotate the discharge pipe 132.

At this time, when the raw material pieces MS are put into the case 170 of the stirring apparatus 130 from the hopper 9, the raw material pieces MS are stirred by the rotator 172 which rotates at the bottom portion inside the case 170. The raw material pieces MS are stirred by the blades 196 of the rotator 172 while being sent outward in a radial direction of the rotator 172, that is, in a direction of the side wall 180 of the case 170. Thus, even when a plurality of types of raw material pieces MS having different densities, thicknesses, colors, and the like are put into, a mixing state of the raw material pieces MS can be easily homogenized inside the case 170. In the rotator 172, the rotating portion 190 and the blade 196, which form a part of the bottom surface 182, rotate integrally. For this reason, for example, unlike the case where only the blade rotates on the bottom surface portion, it is possible to suppress the raw material piece MS from being compressed between the blade 196 and the bottom surface 182 and becoming a lump.

The stirred raw material pieces MS are sent from the discharge portion 186 of the case 170 to the discharge pipe 132 of the transport apparatus 131 by the blade 196. In the discharge pipe 132, the raw material pieces MS sent into the discharge pipe 132 are transported to the outlet 132B while being stirred by the spiral member 140 which rotates together with the discharge pipe 132. Thus, the raw material pieces MS are suppressed from becoming a lump during the transportation of the raw material pieces MS.

The raw material piece MS sent to the measurement portion 134 is put into the reception portion 160 through the upper opening portion 166. When the load cell 164 detects that the raw material pieces MS inside the reception portion 160 reach a preset target value, the control apparatus 110 drives the opening and closing motor 165. As a result, the closing member 162 rotates from the closing position to the opening portion position, and the bottom opening portion 168 of the reception portion 160 is opened. When the bottom opening portion 168 is opened, the raw material piece MS of the reception portion 160 falls by the own weight of the raw material piece MS. The dropped raw material piece MS is transported to the defibration portion 20. In the sheet manufacturing apparatus 100, as the stirring apparatus 130 and the transport apparatus 131 continue to be driven, the transport of the raw material pieces MS to the measurement portion 134 is repeated. Therefore, when the opening and closing motor 165 is operated and the measurement portion 134 is emptied, the control apparatus 110 resets the value of the counted time and repeats to count a time until the measured value of the load cell 164 reaches the target value.

In the transport apparatus 131, there are a case where a large amount of raw material pieces MS are sent from the case 170 of the stirring apparatus 130, and a case where a large amount of raw material pieces MS are discharged from the discharge pipe 132 of the transport apparatus 131.

At this time, the control apparatus 110 changes a rotation state of the transport apparatus 131 based on rotation states of the rotator 172 and the transport apparatus 131. When a time for the weight of the reception portion 160 to reach the preset target value is smaller than the preset threshold value, the control apparatus 110 of the present embodiment rotates the discharge pipe 132 in the reverse direction RV. In other words, the control apparatus 110 rotates the discharge pipe 132 in the reverse direction RV when an increase pace of the weight of the raw material pieces MS is fast. When the time for the weight of the reception portion 160 to reach the preset target value is larger than the preset threshold value, the control apparatus 110 of the present embodiment rotates the discharge pipe 132 in the forward direction RO. In other words, the control apparatus 110 rotates the discharge pipe 132 in the forward direction RO when the increase pace of the weight of the raw material pieces MS is slow. In a case of determining whether the time for the weight of the reception portion 160 to reach the target value is short, a value smaller than the target value may be used instead of the target value for opening and closing the opening and closing motor 165 so as to perform the determination.

As illustrated in FIG. 8, when the discharge pipe 132 rotates in the reverse direction RV, the raw materials MS unevenly stagnate inside the discharge pipe 132, so that the flow of the raw material pieces MS from the case 170 into the discharge pipe 132 is regulated. Therefore, in the present embodiment, it is possible to prevent the raw material pieces MS from flowing into the discharge pipe 132 from the case 170, or to reduce the flow of the raw materials MS, without providing a shutter member which moves the inlet 132A to be able to open and close, and an effect of closing at least a part of the inlet 132A is obtained by the rotation of the discharge pipe 132. A so-called shutter effect can be obtained. Thus, the transport amount of raw material pieces MS inside the discharge pipe 132 can be adjusted. In addition, in a state in which the flow of the raw material pieces MS into the discharge pipe 132 is regulated, the rotator 172 is rotated to stir the raw material pieces MS.

In particular, a winding direction of the spiral member 140 of the present embodiment is a direction of being wound around the central axis L1 in a clockwise direction when the spiral member 140 heads from the inlet 132A toward the outlet 132B along the central axis L1. That is, the spiral member 140 has a winding direction for transporting the raw material pieces MS toward the outlet 132B when the discharge pipe 132 rotates in the forward direction RO, and transporting the raw material pieces MS toward the inlet 132A when the discharge pipe 132 rotates in the reverse direction RV. Therefore, in the present embodiment, when the discharge pipe 132 is rotated in the reverse direction RV so as to regulate the inflow of the raw material pieces MS, inside the discharge pipe 132, the raw materials MS are transported to the inlet 132A side. Therefore, it is easier to further suppress the raw material pieces MS from flowing into the discharge pipe 132 from the case 170.

In the present embodiment, the control apparatus 110 rotates the rotator 172 in the counterclockwise rotation direction R1, but may rotate the rotator 172 in the clockwise direction opposite to the counterclockwise rotation direction R1. In this case, the rotation directions of the discharge pipe 132 when the inflow is allowed and when the inflow is regulated are reversed. That is, when the rotator 172 of the stirring apparatus 130 is rotated in the clockwise direction, when the flow of the raw material pieces MS is allowed, the discharge pipe 132 is rotated in the reverse direction RV, and when the flow of the raw material pieces MS is regulated, the discharge pipe 132 is rotated in the forward direction RO. Further, instead of these, the stirring motor 210 may be configured to be switchable between forward rotation and reverse rotation, and the rotation direction of the rotator 172 may be controlled to be switched by controlling the rotation direction of the stirring motor 210. For example, the control apparatus 110 may perform control to switch the rotation direction of the rotator 172 between the counterclockwise rotation direction R1 and the clockwise rotation direction, at each preset timing. The control apparatus 110 may switch the rotation direction of the discharge pipe 132 between a rotation direction when allowing the inflow and a rotation direction when regulating the inflow in accordance with the rotation direction of the rotator 172. The preset timing may be, for example, a timing at regular time intervals, or a timing at which the closing member 162 of the measurement portion 134 is opened and closed.

In addition, the control apparatus 110 according to the present embodiment rotates the discharge pipe 132 in the reverse direction RV when the weight of the raw material pieces MS in the reception portion 160 increases at a rapid pace. Meanwhile, the rotation of the discharge pipe 132 may be stopped. When the rotation of the discharge pipe 132 is stopped, it is difficult for the raw material pieces MS to be transported in the discharge pipe 132. Therefore, a space in which new raw material pieces MS2 enter near the inlet 132A does not easily occur, and the raw material pieces MS stay inside the upstream case 170 of the inlet 132A and easily blocks the inlet 132A. By stopping the rotation of the discharge pipe 132, the flow of the raw material pieces MS into the discharge pipe 132 can be suppressed, and the transport amount can be adjusted.

As described above, in the present embodiment, the sheet manufacturing apparatus 100 includes the case 170 which accommodates the raw material pieces MS including fibers, the rotator 172 which rotates inside the case 170 to stir the raw material pieces MS, and the stirring motor 210 which rotates the rotator 172. In addition, the sheet manufacturing apparatus 100 includes the transport apparatus 131 which transports the raw material pieces MS through the transport path 133 coupled to the side wall 180 of the case 170, and the control portion which controls the rotation states of the rotator 172 and the transport apparatus 131. The transport apparatus 131 of the sheet manufacturing apparatus 100 includes the discharge pipe 132 which rotates on the central axis L1 along the transport path 133, and the transport motor 150 which rotates the discharge pipe 132. Therefore, by changing the rotation states of the transport apparatus 131 based on the rotation states of the rotator 172 and the transport apparatus 131, the transport amount of raw material pieces MS by the transport apparatus 131 can be adjusted. For this reason, it is possible to stably supply the raw material pieces MS which are raw materials for manufacturing the sheet S from the storage portion 13 to the defibration portion 20, and it is possible to stabilize the amount of raw material pieces MS supplied to the defibration portion 20.

In the present embodiment, the rotation states of the rotator 172 and the discharge pipe 132 have the rotation direction R1 of the rotator 172, and the rotation speed and the rotation directions RO and RV of the discharge pipe 132. That is, the control apparatus 110 performs control to rotate the rotator 172 in the rotation direction R1. Further, the control apparatus 110 performs control to rotate the discharge pipe 132 in the forward direction RO and the reverse direction RV. In this case, the control apparatus 110 performs control to rotate the rotation speed of the discharge pipe 132 at a constant 75 rpm. Here, based on the rotation direction R1 of the rotator 172, the rotation direction of the discharge pipe 132 in a case of allowing the inflow of the raw material piece MS into the discharge pipe 132 and in a case of regulating the flow of the raw material piece MS into the discharge pipe 132 are determined. Therefore, by switching the rotation directions RO and RV of the discharge pipe 132 of the transport apparatus 131 based on the rotation direction R1 of the rotator 172, the transport amount of raw material pieces MS of the transport apparatus 131 can be adjusted.

In the present embodiment, the discharge pipe 132 is a tube which forms the transport path 133, and the transport motor 150 rotates the discharge pipe 132. Therefore, the raw material pieces MS can be transported by passing through the transport path 133 inside the discharge pipe 132.

In the present embodiment, in the discharge pipe 132, one end in an axial direction communicates with the internal space 170A of the case 170, and the other end has the outlet 132B which discharges the raw material pieces MS. Further, on the inner peripheral surface 132C corresponding to an example of an inner surface of the discharge pipe 132, a protrusion formed by a spiral member 140 with respect to the central axis L1 of the discharge pipe 132 is spirally disposed. Therefore, the transport amount can be adjusted by using transport force on the fiber piece MS in accordance with the rotation of the spiral member 140.

Further, in the present embodiment, the discharge pipe 132 is inclined such that the outlet 132B is lower in a vertically downward direction than the discharge portion 186 corresponding to an example of a coupling portion with the case 170. Therefore, the raw materials MA can be easily moved to the outlet 132B side by using gravity.

Further, in the present embodiment, the rotator 172 includes the rotating portion 190 which forms a part of the bottom surface of the case 170, and the blade 196 erected on the rotating portion 190. Therefore, rotation force of the rotator 172 can be largely applied to the raw material pieces MS by the blade 196 of the rotating portion 190.

In the present embodiment, the transport path 133 is coupled to the case 170 at an overlapping position with the blade 196 in a height direction of the case 170. Therefore, when the blade 196 of the rotator 172 stirs the raw material pieces MS, an effect of pushing out the raw material pieces MS from the case 170 to the discharge pipe 132 can be expected. For this reason, the raw material pieces MS can be transported more efficiently by the discharge pipe 132.

As described above, in the fiber transport method of the present embodiment, the sheet manufacturing apparatus 100 is controlled. The sheet manufacturing apparatus 100 includes the case 170 which accommodates the raw material pieces MS including fibers, the rotator 172 which rotates inside the case 170 to stir the raw material pieces MS, and the stirring motor 210 which rotates the rotator 172. In addition, the sheet manufacturing apparatus 100 includes the transport apparatus 131 which transports the raw material pieces MS through the transport path 133 coupled to the side wall 180 of the case 170, and the control apparatus 110 which controls the rotator 172 and the transport apparatus 131. The transport apparatus 131 includes the discharge pipe 132 which rotates on the central axis L1 along the transport path 133, and the transport motor 150 which rotates the discharge pipe 132. In the fiber transport method, the control apparatus 110 controls the transport amount of raw material pieces MS by controlling the stirring motor 210 and the transport motor 150 and adjusting the rotational state of each of the rotator 172 and the discharge pipe 132. Therefore, by adjusting the rotation state of each of the rotator 172 and the discharge pipe 132, the transport amount of raw material pieces MS can be adjusted.

2. Second Embodiment

2-1. Configuration of Storage Portion of Sheet Manufacturing Apparatus

Next, a second embodiment according to the present disclosure will be described. The same components as those in the above-described first embodiment are denoted by the same reference numerals, and description thereof will not be repeated.

Figure 10:
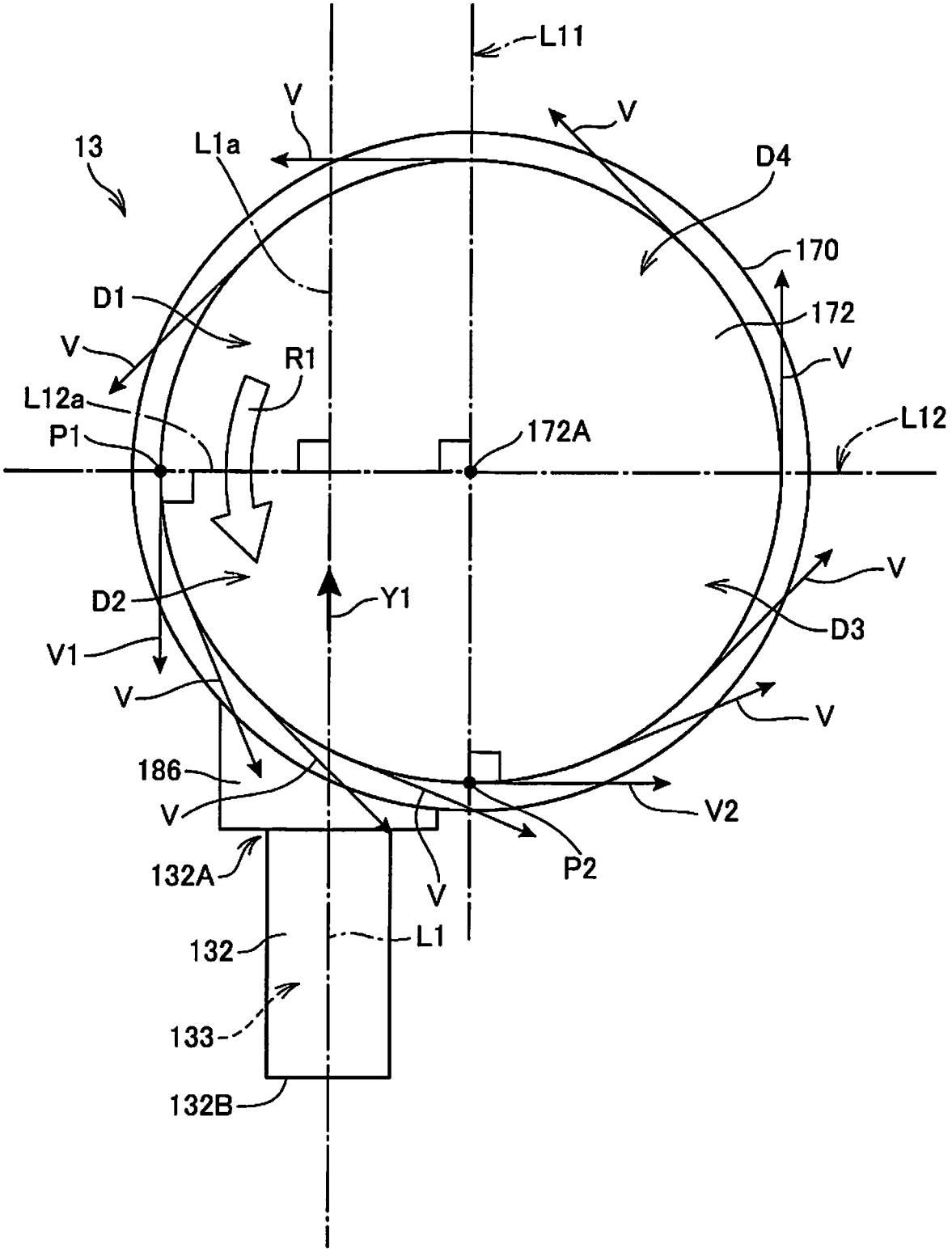
FIG. 10 is a schematic diagram corresponding to a plan view of a storage portion according to a second embodiment.

FIG. 10 is a schematic diagram corresponding to a plan view of the storage portion 13 according to the second embodiment.

As illustrated in FIG. 10, in the storage portion 13 of the second embodiment, the discharge pipe 132 which forms the transport path 133 is different from the first embodiment in that the extension axis L1*a* is a disposed axis shifted on the left from the rotation center 172A of the rotator 172 in plan view. The extension axis L1*a* is orthogonal to a virtual half-line L12*a* as a portion of the second virtual straight line L12 extending on the left from the rotation center 172A.

In the present embodiment, the inlet 132A of the discharge pipe 132 faces the region D2 on the left side of the discharge pipe 132 than the second virtual straight line L12. The inlet 132A of the discharge pipe 132 is disposed on a tangent to the outer peripheral portion of the rotator 172 in the region D2.

The control apparatus 110 rotates the rotator 172 so that the rotator 172 at a portion passing through the virtual half-line L12*a* moves in a direction approaching the inlet 132A of the discharge pipe 132. That is, the control apparatus 110 rotates the rotator 172 in the counterclockwise rotation direction R1 in plan view.

In this case, the region D2 corresponds to a region from when the rotator 172 passes through the virtual half-line L12*a* to when the rotator 172 rotates on the rotation center 172A by 90 degrees in the rotation direction R1.

A velocity vector V1 of the outer peripheral portion of the rotator 172 at a position P1 on the virtual half-line L12*a* is parallel to the extension axis L1*a*, and faces in a direction opposite to the extension direction Y1 of the extension axis L1*a*. Further, a velocity vector V2 of the outer peripheral portion of the rotator 172 at a position P2 rotated on the rotation center 172A by 90 degrees in the rotation direction R1 from the position P1 on the virtual half-line L12*a* is orthogonal to the extension axis L1*a*, and faces in a direction away from the extension axis L1*a*.

In addition, the velocity vector V of the rotator 172 in the region D2 tends to have a component in a direction approaching the inlet 132A. Further, the velocity vector V of the rotator 172 in the region D2 tends to have a component in a direction crossing the central axis L1 or the extension axis L1*a* from left to right in accordance with the rotation direction R1. Therefore, the raw material pieces MS receive force from the rotator 172 and tend to enter the discharge pipe 132 on the right from the central axis L1.

2-2. Operation of Storage Portion of Sheet Manufacturing Apparatus

In the storage portion 13 of the sheet manufacturing apparatus 100 according to the second embodiment, when the raw material pieces MS flow into the discharge pipe 132, the raw material pieces MS tend to flow on the right of the central axis L1. Therefore, in the same manner as the first embodiment, the control apparatus 110 controls the transport motor 150 to control the rotation state such as the rotation speed or the rotation direction of the discharge pipe 132, so that the flow amount of raw material pieces MS into the discharge pipe 132 is adjusted.

In the present embodiment, in the region D2 facing the inlet 132A, the rotator 172 rotates in a direction approaching the inlet 132A. For this reason, the raw material pieces MS easily receive force in the direction approaching the inlet 132A from the rotator 172, and the raw material pieces MS tend to flow into the discharge pipe 132 through the inlet 132A. Therefore, in the present embodiment, the raw material pieces MS can easily flow into the discharge pipe 132, and the transport amount of raw material pieces MS can be easily increased.

As described above, also in the second embodiment, in the same manner as the first embodiment, the control apparatus 110 controls the stirring motor 210 and the transport motor 150 to adjust the rotation state such as the rotation speed or the rotation direction of each of the rotator 172 and the discharge pipe 132, so that the transport amount of raw material pieces MS is controlled. Therefore, in the same manner as the first embodiment, the transport amount of raw material pieces MS can be adjusted.

Further, in the present embodiment, the virtual half-line L12*a* extends in a radial direction from the rotation center 172A of the rotator 172 and defines a passing position of the rotator 172 in a circumferential direction. The half-linear extension axis L1*a* extending from the central axis L1 of the discharge pipe 132 to the outside of the transport path 133 is orthogonal to the virtual half-line L12*a* at a position shifted from the rotation center 172A of the rotator 172. The control apparatus 110 rotates the rotator 172 so that the rotator 172 at a portion passing through the virtual half-line L12*a* moves in a direction approaching the transport path 133. Therefore, the large amount of raw material pieces MS can easily flow into the discharge pipe 132, and the transport amount can be easily increased.

3. Third Embodiment

3-1. Configuration of Storage Portion of Sheet Manufacturing Apparatus

Next, a third embodiment according to the present disclosure will be described. The same components as those in the above-described first embodiment are denoted by the same reference numerals, and description thereof will not be repeated.

Figure 11:
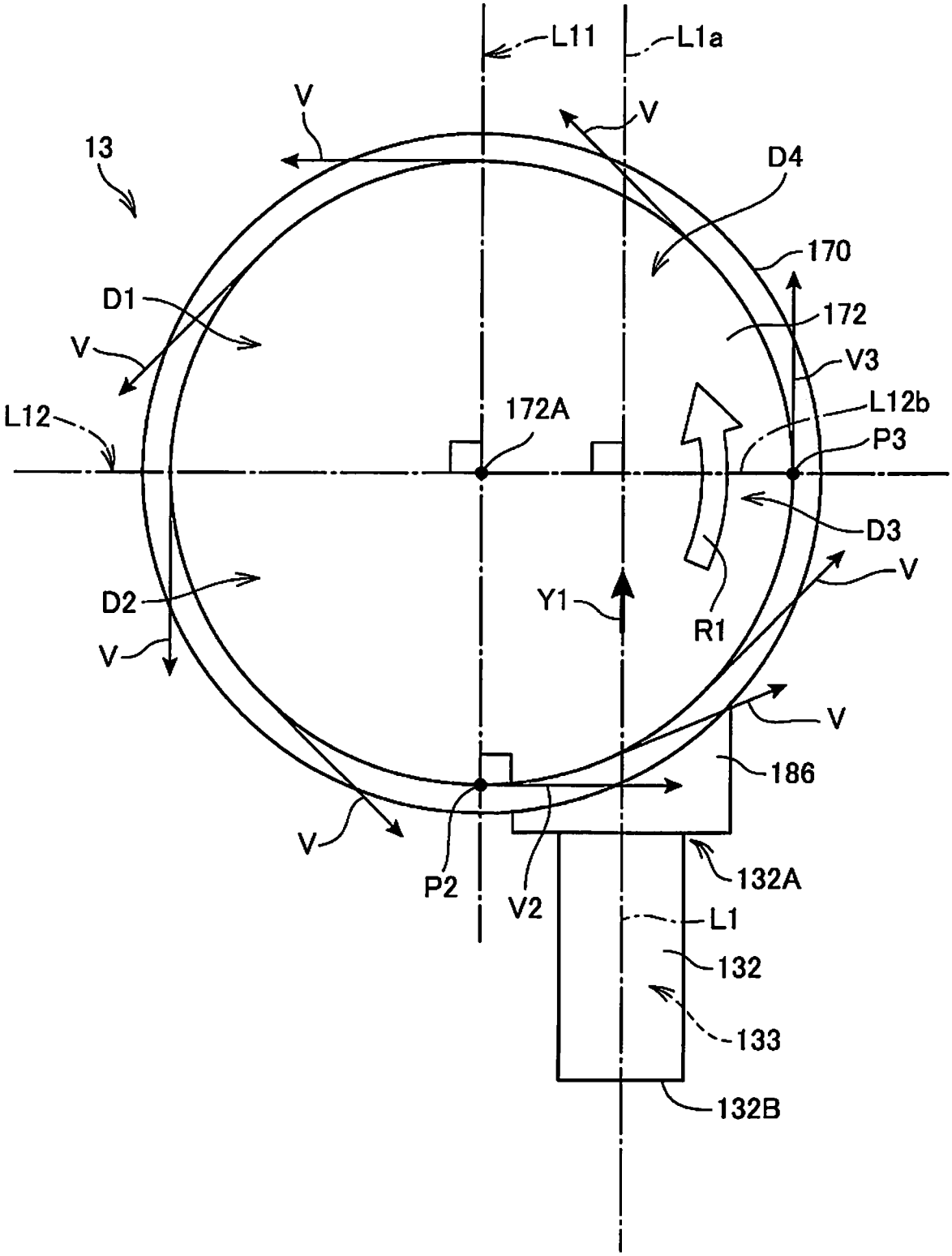
FIG. 11 is a schematic diagram corresponding to a plan view of a storage portion according to a third embodiment.

FIG. 11 is a schematic diagram corresponding to a plan view of the storage portion 13 according to the third embodiment.

As illustrated in FIG. 11, in the storage portion 13 of the third embodiment, the discharge pipe 132 which forms the transport path 133 is different from the first embodiment in that the extension axis L1*a* is a disposed axis shifted on the right from the rotation center 172A of the rotator 172 in plan view. The extension axis L1*a* is orthogonal to a virtual half-line L12*b* as a portion of the second virtual straight line L12 extending on the right from the rotation center 172A.

In the present embodiment, the inlet 132A of the discharge pipe 132 faces the region D3 on the right side of the discharge pipe 132 than the second virtual straight line L12. The inlet 132A of the discharge pipe 132 may be disposed on a tangent to the outer peripheral portion of the rotator 172 in the region D3.

The control apparatus 110 rotates the rotator 172 so that the rotator 172 at a portion passing through the virtual half-line L12*b* moves in a direction away from the inlet 132A of the discharge pipe 132. That is, the control apparatus 110 rotates the rotator 172 in the counterclockwise rotation direction R1 in plan view.

In this case, the region D3 corresponds to a region when the rotator 172 rotates on the rotation center 172A by 90 degrees in the rotation direction R1 until the rotator 172 reaches the virtual half-line L12*b*.

A velocity vector V3 of the outer peripheral portion of the rotator 172 at a position P3 on the virtual half-line L12*b* is parallel to the extension axis L1*a*, and faces in the same direction as the extension direction Y1 of the extension axis L1*a*. Further, the velocity vector V2 of the outer peripheral portion of the rotator 172 at the position P2 rotated on the rotation center 172A by 90 degrees in a direction opposite to the rotation direction R1 from the position P3 on the virtual half-line L12*b* is orthogonal to the extension axis L1*a*, and faces in a direction approaching the extension axis L1*a*.

Further, the velocity vector V of the rotator 172 in the region D3 tends to have a component in a direction away from the inlet 132A. Further, the velocity vector V of the rotator 172 in the region D3 tends to have a component in a direction crossing the central axis L1 or the extension axis L1*a* from left to right in accordance with the rotation direction R1. Therefore, the raw material pieces MS receive force from the rotator 172 and tend to enter the discharge pipe 132 on the right from the central axis L1.

3-2. Operation of Storage Portion of Sheet Manufacturing Apparatus

In the storage portion 13 of the sheet manufacturing apparatus 100 of the third embodiment, when the raw material pieces MS flow into the discharge pipe 132, the raw material pieces MS tend to flow on the right of the central axis L1. Therefore, in the same manner as the first embodiment, the control apparatus 110 controls the transport motor 150 to control the rotation state such as the rotation speed or the rotation direction of the discharge pipe 132, so that the flow amount of raw material pieces MS into the discharge pipe 132 is adjusted.

In the present embodiment, in the region D3 facing the inlet 132A, the rotator 172 rotates in a direction away from the inlet 132A. For this reason, even when the raw material pieces MS are regulated and stay on the case 170 side of the inlet 132A, the remaining raw material pieces MS are easily separated from the inlet 132A together with the rotator 172. Therefore, in the present embodiment, the raw material pieces MS hardly flow into the discharge pipe 132, and the transport amount of raw material pieces MS is easily reduced.

As described above, also in the third embodiment, in the same manner as the first embodiment, the control apparatus 110 controls the stirring motor 210 and the transport motor 150 to adjust the rotation state such as the rotation speed or the rotation direction of each of the rotator 172 and the discharge pipe 132, so that the transport amount of raw material pieces MS is controlled. Therefore, in the same manner as the first embodiment, the transport amount of raw material pieces MS can be adjusted.

Further, in the present embodiment, the virtual half-line L12*b* extends in a radial direction from the rotation center 172A of the rotator 172 and defines a passing position of the rotator 172 in a circumferential direction. The half-linear extension axis L1*a* extending from the central axis L1 of the discharge pipe 132 to the outside of the transport path 133 is orthogonal to the virtual half-line L12*b* at a position shifted from the rotation center 172A of the rotator 172. The control apparatus 110 rotates the rotator 172 so that the rotator 172 at a portion passing through the virtual half-line L12*b* moves in a direction away from the transport path 133. Therefore, the raw material pieces MS hardly flow into the discharge pipe 132, and the transport amount is easily reduced.

4. Other Embodiments

Each of the above-described embodiments is merely a specific mode for implementing the present disclosure described in the claims, does not limit the present disclosure, and can be implemented in various aspects without departing from the gist thereof.

In the above embodiment, the configuration in which the spiral member 140 is provided is described, but the spiral member 140 may be omitted. When the spiral member 140 is omitted, when the discharge pipe 132 rotates, the raw material pieces MS inside the discharge pipe 132 move upward by centrifugal force or the like, then collapse and move downward, and move to the outlet 132B side. By repeating these, the raw material pieces MS can be transported inside the discharge pipe 132.

In the above-described embodiment, the configuration in which as the rotator 172, the disk-shaped rotating portion 190 rotates is described. Meanwhile, as described in JP-A-2011-241497, a rotator may be configured by a rotating shaft and a rod member supported by the rotating shaft, and the rotator may be rotated inside the case 170.

In the above embodiment, the spiral member 140 corresponding to an example of the protrusion is formed integrally and continuously in the longitudinal direction, but a configuration in which a plurality of spiral members separated in the longitudinal direction may be provided. Further, the protrusion needs not be a plate material which is spirally curved.

In the above embodiment, a closing member which closes a part of the inlet 132A may be provided. For example, the closing member which closes the downstream in the rotation direction R1 of the rotator 172 of the inlet 132A with respect to the central axis L1 is provided. Thus, when the raw material pieces MS flow from the downstream in the rotation direction R1 of the rotator 172 of the inlet 132A, it is possible to efficiently control the inflow of the raw material pieces MS.

In the second embodiment, the control apparatus 110 controls the rotation of the rotator 172 in the rotation direction R1 so that the raw material pieces MS can easily flow into the discharge pipe 132. Meanwhile, in order to make the inflow of the raw material pieces MS difficult, the rotator 172 may be rotated in a direction opposite to the rotation direction R1 in the storage portion 13 according to the second embodiment.

In the third embodiment, the control apparatus 110 controls the rotation of the rotator 172 in the rotation direction R1 so that the raw material pieces MS do not easily flow into the discharge pipe 132. Meanwhile, in order to facilitate the inflow, the rotator 172 may be rotated in a direction opposite to the rotation direction R1 in the storage portion 13 of the third embodiment.

In the above embodiment, the control apparatus 110 performs the control of rotating the rotator 172 or the discharge pipe 132 at a constant rotation speed. Meanwhile, instead of this, the control apparatus 110 may be configured to perform control of changing the rotation speed of the rotator 172 or the discharge pipe 132. For example, the rotation speed of the rotator 172 may be increased in a case of increasing the stirring action of the rotator 172, and the rotating speed of the rotator 172 may be decreased in a case of suppressing the stirring action of the rotator 172. Further, for example, control may be performed to increase or decrease the rotation speed of the discharge pipe 132 in accordance with increase or decrease of the rotation speed of the rotator 172.

What is claimed is:

1. A fiber transport apparatus comprising:

a case that accommodates fiber pieces containing fibers;

a stirring portion that rotates inside the case to stir the fiber pieces, the stirring portion including a rotating portion that forms a part of a bottom surface of the case, and a blade erected on the rotating portion;

a first driving portion that rotates the stirring portion;

a transport apparatus that transports the fiber pieces through a transport path coupled to a side surface of the case; and a control portion that controls rotation states of the stirring portion and the transport apparatus, the transport apparatus including a rotator that rotates on an axis along the transport path, and a second driving portion that rotates the rotator, and the transport path being coupled to the case at an overlapping position at which the transport path partially overlaps the blade in a height direction of the case as viewed in a perpendicular direction perpendicular to the height direction, the height direction being along an axial direction of the stirring portion.

2. The fiber transport apparatus according to claim 1, wherein the rotation states of the stirring portion and the rotator are at least one of a rotation speed and a rotation direction of the stirring portion, and at least one of a rotation speed and a rotation direction of the rotator.

3. The fiber transport apparatus according to claim 1, wherein the rotator is a tube that forms the transport path, and the second driving portion rotates the tube.

4. The fiber transport apparatus according to claim 3, wherein one end of the tube in an axial direction of the rotator communicates with an internal space of the case, and the other end has an outlet for discharging the fiber piece, and a protrusion is disposed on an inner surface of the tube in a spiral shape on an axis of the tube.

5. The fiber transport apparatus according to claim 4, wherein the tube is inclined so that the outlet is lower in a vertically downward direction than a coupling portion with the case.

6. The fiber transport apparatus according to claim 1, wherein a half-linear extension virtual line extending from the axis of the rotator to an outside of the transport path is orthogonal to a virtual half-line extending from a rotation center of the stirring portion in a radial direction and defining a passing position of the stirring portion in a circumferential direction, at a position shifted from the rotation center of the stirring portion, and the control portion rotates the stirring portion such that a portion of the stirring portion passing through the virtual half-line moves in a direction approaching the transport path.

7. The fiber transport apparatus according to claim 1, wherein a half-linear extension virtual line extending from the axis of the rotator to an outside of the transport path is orthogonal to a virtual half-line extending from a rotation center of the stirring portion in a radial direction and defining a passing position of the stirring portion in a circumferential direction, at a position shifted from the rotation center of the stirring portion, and the control portion rotates the stirring portion such that a portion of the stirring portion passing through the virtual half-line moves in a direction away from the transport path.

8. A fiber transport method of controlling a fiber transport apparatus including a case that accommodates fiber pieces containing fibers, a stirring portion that rotates inside the case to stir the fiber pieces, the stirring portion including a rotating portion that forms a part of a bottom surface of the case, and a blade erected on the rotating portion, a first driving portion that rotates the stirring portion, a transport apparatus that transports the fiber pieces through a transport path coupled to a side surface of the case, and a control portion that controls the stirring portion and the transport apparatus, the transport apparatus including a rotator that rotates on an axis along the transport path and a second driving portion that rotates the rotator, and the transport path being coupled to the case at an overlapping position at which the transport path partially overlaps the blade in a height direction of the case as viewed in a perpendicular direction perpendicular to the height direction, the height direction being along an axial direction of the stirring portion, the method comprising:

causing the control portion to control the first driving portion and the second driving portion, adjusting a rotation state of each of the stirring portion and the rotator, and controlling a transport amount of the fiber pieces.

* * * * *